United States Patent [19]

Escue et al.

[11] Patent Number: 5,049,046

[45] Date of Patent: Sep. 17, 1991

[54] PUMP CONTROL SYSTEM FOR A DOWNHOLE MOTOR-PUMP ASSEMBLY AND METHOD OF USING SAME

[75] Inventors: Nelson B. Escue, La Mesa; Vance E. Bolding, Huntington Beach, both of Calif.; Howard C. Hornsby, West Palm Beach, Fla.

[73] Assignee: Escue Research and Development Company, San Diego, Calif.

[21] Appl. No.: 462,833

[22] Filed: Jan. 10, 1990

[51] Int. Cl.[5] ..... F04B 47/06

[52] U.S. Cl. ..... 417/411; 417/417; 417/448; 166/66

[58] Field of Search ..... 417/411, 414, 417, 448, 417/449, 450; 166/66; 388/832, 814, 812; 318/115; 310/14

[56] References Cited

U.S. PATENT DOCUMENTS

| | | | |
|---|---|---|---|
| 3,445,688 | 5/1969 | Thorel et al. . | |
| 4,350,478 | 9/1982 | Oldershaw et al. | 417/417 |
| 4,477,235 | 10/1984 | Gilmer et al. | 417/414 |
| 4,518,317 | 5/1985 | Inoue | 310/14 |
| 4,562,385 | 12/1985 | Rabson | 318/135 |
| 4,687,054 | 8/1987 | Russell et al. | 417/417 |
| 4,815,949 | 3/1989 | Rabson | 417/417 |

*Primary Examiner*—Leonard E. Smith
*Assistant Examiner*—David W. Scheuermann
*Attorney, Agent, or Firm*—Bernard L. Kleinke; William P. Waters; Jerry R. Potts

[57] ABSTRACT

A new and improved control system for monitoring and controlling the operation of a downhole linear d.c. motor-pump assembly and a method of using it for producing a sufficient reciprocating pumping action to lift well fluid through the producing tubing of a well to the ground surface. The system includes a surface monitoring station that is in radio communication with a plurality of remote downhole motor-pump assemblies. Each motor-pump assembly has a surface motor controller, a downhole motor-pump cartridge unit that is adapted to be received in a downhole cartridge sleeve assembly that maintains the cartridge unit in a stationary position for pumping purposes. The motor-pump cartridge unit may be raised or lowered by a control cable within the production tubing for helping to facilitate the repair or replacement of the motor-pump cartridge unit. The motor-pump assembly also includes a plurality of sensors for monitoring the conditions of the well downhole as well as the efficiency of the motor-pump cartridge unit.

20 Claims, 4 Drawing Sheets

525D
19
525B
605

602
525A
525C
601
602A
606
FILTER NETWORK
PWR. ISO.
TRAN/ RX
SIGNAL CONTROL UNIT
602B
604A
622
601B
604
612
601A
COIL SWIT. UNIT
604A
30
632
602C
602D
603
PWR. SW.
612A
616A
616
612B
29
608
604B
609
613A
613
SEN
622B
PWR. SW.
31
621
613B
29C
617
604C
617A
622A
634
621A
PWR. SW.
614
132
614A
600
610
614B
30A
130
618
618A 415
415A
416
404
TERM
11
TRANS./RX.
417
CPU
402
416A
410A
MODEM
KEYBOARD
418B
407
PWR. SUPY.
418
418A
410
U5V INPUT

PUMP CONTROL SYSTEM FOR A DOWNHOLE MOTOR-PUMP ASSEMBLY AND METHOD OF USING SAME

DESCRIPTION

1. Technical Field

This invention relates to the general field of pumping systems for lifting downhole oil well fluids to the ground surface. More particularly, the present invention relates to a pump control system for use with a downhole linear d.c. motor-pump assembly and a method of using the same for producing reciprocating action of a pump piston.

2. Background Art

There have been many different types and kinds of pump control system for downhole well use and methods of using them relating to the controlling of the reciprocating action of a piston pump by a motor.

Conventional pump control systems and motor-pump assemblies of the general type with which the present invention is concerned are employed for lifting oil well fluids from the bottom of a well to the ground surface. The conventional, prior known motor-pump assemblies generally include an electrically actuated motor interconnected between a downhole pump by a connecting rod and a control system at the surface of the well.

While such systems may have been successful in many applications, they have proven to be less than satisfactory when placed in commercial production wells which are of a marginal production value. In this regard, because the fluids produced within a well diminish with time it has proven difficult, if not impossible, to adjust the performance of the downhole motor-pump assembly in a cost effective manner to accommodate the changing well production conditions. Moreover, if a connection rod breaks or the downhole pump fails, the long connecting rod and pump must be removed mechanically from the well for repair and then mechanically lowered back down into the well. In this regard, many times during pumping operations, the piston rod damages the production tubing and thus necessitates its removal and replacement.

Therefore it would be highly desirable to have a new and improved pump control system and method of using it for lifting downhole oil well fluids to the ground surface that would substantially eliminate the problems associated with the prior art systems. More particularly, the system should not necessitate the use removal and replacement of long piston rods and should eliminate the danger of damaging the production tubing.

Another problem associated with conventional motor-pump assemblies with which the present invention is concerned has been the down time associated with wells whenever a pump fails. In this regard it is very time consuming and costly to remove the pump from the well for repair purposes.

One attempted solution addressed to the concerns of the prior art is disclosed in U.S. Pat. No. 4,350,478 which discloses a downhole linear motor-pump assembly which is lowered by a cable downhole into the well fluids. While such an approach attempted to address the concerns of low production wells it did not prove to be entirely satisfactory because the assembly was not entirely properly supported downhole for efficient pumping.

In this regard, to develop a sufficient pumping action a motor-pump assembly requires a fulcrum or adequate attachment to the surrounding structure, upon which to exert its driving force.

Therefore it would be highly desirable to have a motor-pump assembly that may be easily raised or lowered within the production tubing of a well and which can develop sufficient pumping action to lift well fluids at the bottom of the well to the well surface at an effective pumping rate.

Another problem associated with a downhole motor-pump assembly is the problem associated with controlling the linear direct current (d.c.) motor downhole. More particularly, the armature of a linear d.c. motor must be reciprocated in a up and down motion for driving the pump piston in an efficient and effective manner. Thus, the linear motor requires a set of discrete windings which must be sequentially activated to produce the desired driving force. In order to properly sequence and control the linear motion of the stator, motor control signals must be sent downhole over long distances along with the high voltage pulses necessary to drive the motor. Such combining of high and low voltage signals in a long cable, makes it difficult, if not impossible, to control the downhole motor from the ground surface due to signal interference or loss of the control signal due to the inherent resistance of such a long cable.

Therefore it would be highly desirable to have a new and improved pump motor control system and method of using it for controlling and adjusting the performance and pumping rate of a downhole linear motor in a reliable and cost effective manner. Also, such a motor control should be adjustable to compensate for pumping rates for a declining supply of fluids in a wall.

Yet another concern of the prior art with respect to well down time has been the need to send highly qualified technical personnel to the oil well field to test the operation and efficiency of each of the downhole motor-pump assemblies. In this regard, prior known monitoring arrangements have only monitored a few variables and thus specific identification of certain malfunctions has not been entirely possible. As a result, cost and extensive service calls are required to identify and replace faulty pumps and motors and oftentimes, repeated service calls may be required before an actual faulty device is located and repaired or replaced Such an arrangement has been very costly.

Still another problem that has been a concern of the prior art has been the cost associated with repairing or replacing a downhole motor-pump assembly In this regard, because the motor-pump assembly has been an integral unit, it has proven difficult, if not impossible to repair or replace only the motor in a cost effective and efficient manner.

Therefore it would be highly desirable to have a motor-pump assembly that would be an integral unit but yet that would lend itself to the repair or replacement of either the motor or the pump in the event either of these units fail.

Therefore, it would be highly desirable to have a new and improved control system for use with a downhole well pump and linear d.c. motor that could monitor the operation and efficiency of a downhole motor-pump assembly in a simple and cost effective manner.

DISCLOSURE OF INVENTION

Therefore, it is the principal object of the present invention to provide a new and improved control system for use with a downhole linear d.c. motor-pump assembly and a method of using the same for producing a highly efficient reciprocating action for well fluid pumping purposes.

Another object of the present invention is to provide such a new and improved control system for use with a downhole linear d.c. motor-pump assembly which enables the efficiency of the motor to be easily adjusted for changing downhole well conditions.

Still another object of the present invention is to provide a new and improved control system for use with a downhole linear d.c. motor-pump assembly that can effectively monitor the operation and efficiency of a downhole motor-pump assembly in a simple and cost effective manner.

Still yet another object of the present invention is to provide a new and improved motor-pump assembly that can develop a sufficient pumping action to lift downhole well fluids to the surface of a well and yet be easily retrieved from downhole for repair or replacement purposes.

Briefly, the above and further objects of the present invention are realized by providing a new and improved control system for monitoring and controlling the operation of a downhole linear d.c. motor-pump assembly and a method of using it for producing a sufficient reciprocating pumping action to lift well fluid through the producing tubing of a well to the ground surface. The system includes a surface monitoring station that is in radio communication with a plurality of remote downhole motor-pump assemblies. Each motor-pump assembly has a surface motor controller, a downhole motor-pump cartridge unit and a downhole cartridge sleeve assembly that is adapted to receive and maintain the cartridge unit in a stationary position for pumping purposes. The motor-pump cartridge unit may be raised or lowered by a control cable within the production tubing for helping to facilitate the repair or replacement of the motor-pump cartridge unit. The motor-pump assembly also includes a plurality of sensors for monitoring the conditions of the well downhole as well as the efficiency of the motor-pump cartridge unit.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figures 1, 3, 4:
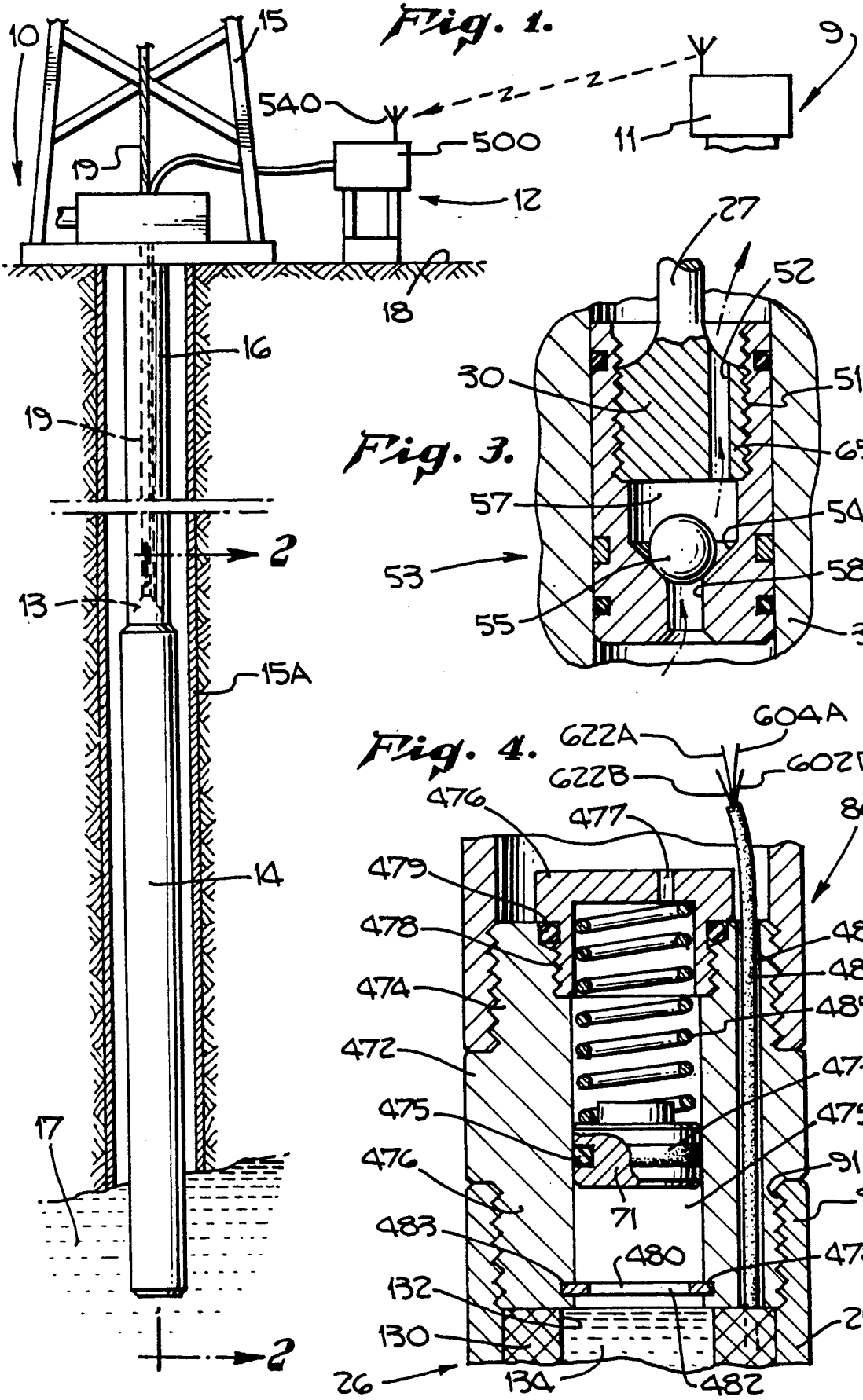
FIG. 1 is a sectional view of a well containing a downhole linear d.c. motor-pump cartridge unit which is constructed in accordance with the present invention.
FIG. 3 is a cross section view of the linear d.c. motor armature connecting rod, and the piston pump illustrated in FIG. 2*b*, taken substantially on line 3—3.
FIG. 4 is a greatly enlarged cross sectional view of the linear d.c. motor oil pressure compensator of the cartridge unit of FIG. 2*a*, taken substantially on line 4–4.

Referring now to the drawings, and more particularly to FIG. 1 thereof, there is shown a pump control system 9 for use with a downhole linear d.c. motor-pump assembly 10, which is constructed in accordance with the present invention.

Figure 2A:
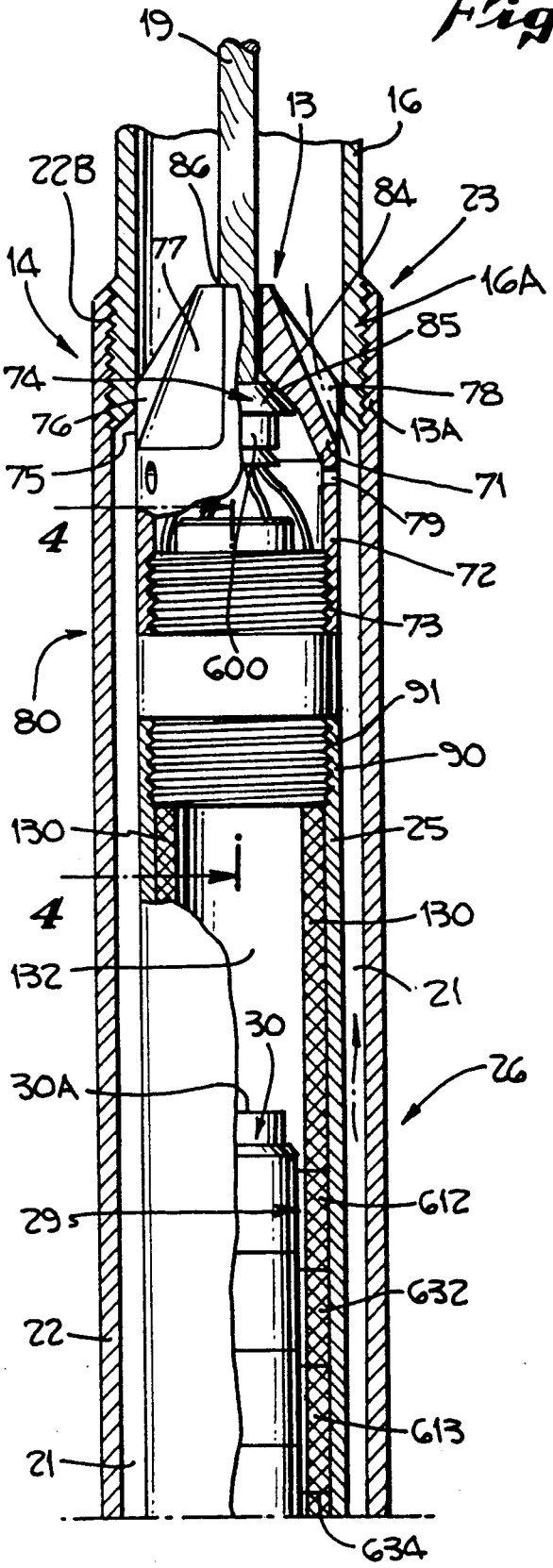
FIG. 2*a* is a greatly enlarged partially cut away cross sectional view of the top portion of the motor-pump cartridge unit disposed within the production tubing of the well of FIG. 1, taken substantially on line 2—2.
Figure 2B:
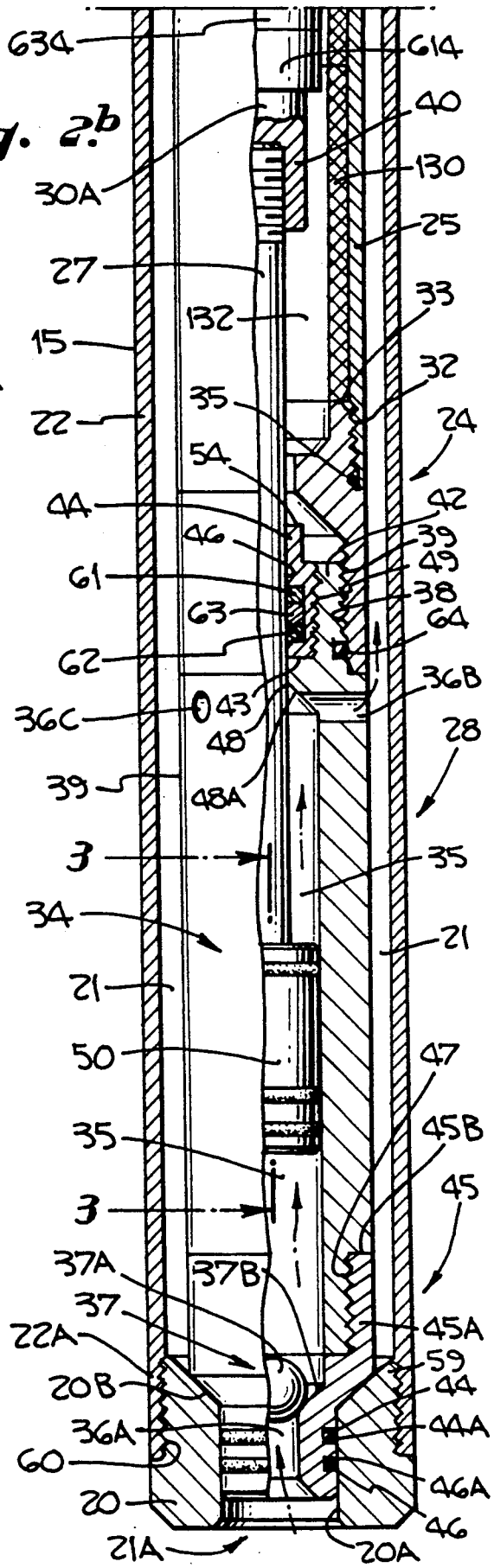
FIG. 2*b* is a greatly enlarged partially cut away cross sectional view of the bottom portion of the motor-pump cartridge unit of FIG. 1, taken substantially on line 2—2.

The pump control system 9 generally comprises a surface monitoring station 11 that is in radio communication with a plurality of downhole linear d.c. motor-pump assemblies, such as motor-pump assembly 10. Each of the downhole linear d.c. motor-pump assemblies such as assembly 10, includes a downhole motor-pump cartridge unit 13 for pumping well fluids 17 from a conventional oil well 15 and a motor controller 12 having a surface motor pulse control assembly 500 and a downhole motor control electronic unit 600 for controlling the operation of the downhole motor-pump cartridge unit 13. In order to permit the transportation of the well fluids 17 to the surface 18, oil well 15 includes a casing 15A and a set of interconnected production tubes or tubing 16 disposed therein As best seen in FIGS. 1, 2*a*, and 2*b*, the production tubing 16 terminates downhole in a downhole cartridge sleeve assembly 14 having a sealing seat 20 which is adapted to receive and support the motor-pump cartridge unit 13 in a stationary downhole position within the hollow interior of the sleeve 14 for fluid pumping purposes. In this regard, the sealing seat includes a centrally disposed hole or opening 20A that permits the well fluids to enter the motor-pump cartridge unit 13 for pumping the well fluids to the surface 18. A control cable 19 disposed within the hollow interior of the production tubing 16 and attached to the motor-pump cartridge 13 permits the motor-pump cartridge 13 to be raised or lowered within the tubing 16 for helping to facilitate the repair or replacement of the motor-pump cartridge unit 13.

In operation, the motor-pump cartridge unit 13 is lowered by control cable 19 into the well 15 through the production tubing 16. The cartridge unit 13 is received within the cartridge sleeve assembly 14 which secures removably the cartridge unit 13 within the centrally disposed sealing seat 20. In this regard, when the cartridge unit 13 is received within the interior of the cartridge sleeve assembly 14, the sleeve 14 matingly engages and supports the cartridge unit 13. A substantially fluid tight seal is formed between the cartridge unit 13 and the seat 20 of the cartridge sleeve assembly 14 as will be explained hereinafter in greater detail. It should be understood however, that the static head of the fluids 17 in the production tubing 16 helps facilitate the cartridge unit 13 being held in mating engagement with seat 20.

Power is then applied to the motor-pump cartridge unit 13 via the control cable 19 to initiate a fluid pumping action. In this regard, the seat 20 serves as a fulcrum so that fluids in the well may be discharged from the motor-pump cartridge unit 13 and pumped upwardly into the production tubing 16 for transportation to the surface.

Considering now the downhole cartridge sleeve assembly 14 in greater detail with reference to FIGS. 1, *2a* and *2b*, the downhole cartridge sleeve assembly 14 generally comprises a hollow cylindrical sleeve 22 and the sealing seat 20 for receiving and supporting from below the downhole motor-pump cartridge unit 13. Sleeve 22 includes an annular base or lower end threaded portion 22A that is adapted to threadably engage the sealing seat 20. Sleeve 22 also includes a top threaded neck portion 22B that is adapted to threadably engage a threaded coupling 16A disposed at the lower end of the production tubing 16 of the well for removably attaching the sleeve 22 to the production tubing 16.

The interior of the cartridge sleeve assembly 14 is dimensioned to loosely receive the motor-pump cartridge unit 13. An annular space 21 at the interior wall of the cartridge sleeve assembly 14 receives well fluids 17 pumped by the cartridge unit 13 through the opening 20A disposed in seat 20. In this regard, cartridge unit 13 discharges well fluids 17 into space 21 through a set of discharge ports, such as ports 36B and 36C (FIG. *2b*) and thence, upwardly through space 21 and into the production tubing 16 for fluid transportation to the well surface 18.

Considering now the seat 20 in greater detail with reference to FIG. *2b*, seat 20 generally has a unitary construction and is composed of a suitable production tubing material. The seat 20 is generally cylindrically shaped and includes a threaded neck portion 59 terminating in a lip defining a centrally disposed opening, shown generally at 21A. Neck portion 59 includes a set of threads 60 for threadably attaching seat 20 to the sleeve 22.

Opening 21A is dimensioned to releasably securely receive and support the lower or bottom portion of the cartridge unit 13. In this regard opening 21A includes the bottom opening 20A that is generally cylindrically shaped and dimensioned to sealingly engage and support the bottom portion of the cartridge unit 13 so that well fluids are substantially prevented from passing between their engaging surfaces into the annular space 21. Opening 21A also includes a top tapered shoulder portion 20B that converges radially inwardly toward opening 20A to support from below the bottom portion of the cartridge unit 13.

Considering now the downhole motor-pump cartridge unit 13 in greater detail with reference to FIG. 1, *2a*, *2b*, and 7, the motor-pump cartridge unit 13 is generally cylindrical in shape having a modular construction. The motor-pump cartridge unit 13 includes a linear direct current motor shown generally at 26 that is interconnected to a piston pump shown generally at 28 for pumping the well fluids 17 to the surface of the well 15.

As best seen in FIGS. *2a* and *2b*, a sealing unit 24 is disposed between the linear motor 26 and pump 28 for receiving a pump connecting rod 27 which couples the motor 26 to the pump 28 and for sealing the motor lubricating fluids (not shown) of the motor 26 from the well fluids 17 being discharged from the pump 28. The sealing unit 24 includes a centrally disposed hole or opening 54 for receiving the pump connecting rod 27 which couples the motor 26 to the pump 28 and so that the driving reciprocating force of the motor 26 may be transferred to the piston pump 28, as will be explained hereinafter in greater detail.

In order to equalize the fluid pressures between the motor lubricating oil disposed in the interior of the motor 26 with the fluids being discharged by the pump 28, the motor-pump cartridge unit 13 also includes a pressure compensator, shown generally at 80 in FIGS. *2a* and 4. Pressure equalization between the motor 26 and pump 28 is necessary to limit or substantially eliminate leakage and contamination of the motor lubricating oils through the sealing unit 24. The pressure compensator 80 is generally cylindrical in shape and includes an upper and lower threaded neck portion shown generally at 33 and 38 respectively, for interconnecting the pressure compensator 80 between the linear direct current motor 26 and a motor cable terminator assembly, shown generally at 23.

As best seen in FIG. *2a*, the motor/cable terminator assembly includes a cable terminator, shown generally at 74 for attaching the cable 19 to the motor 26 and a set of downhole sensors 616 to 618, and 621 (FIG. 5) for monitoring the conditions of the well downhole as well as the efficiency and operation of the motor 26.

The motor/cable terminator assembly 23 permits the cartridge unit 13 to be withdrawn or hoisted from the well 15 through the production tubing 16 without placing undue stress on the electrical conductors of the motor 26. As will be explained hereinafter in greater detail, the control cable 19 includes a signal/power coaxial conductor pair 525A and 525B, and a pulse power coaxial conductor 524A that provide an appropriate pulse current to the linear motor 26 and a bidirectional communication path for sequencing motor operations downhole and supplying downhole information surface for maintenance purposes.

As best seen in FIGS. 1, *2a* and *2b*, the motor cable terminator assembly 23, sealing unit 24, motor 26, and pump 28 form the modular cartridge pump unit 13 which may be easily disassembled for maintenance repair purposes.

Considering now the piston pump 28 in greater detail with reference to FIG. *2b*, the piston pump 28 generally comprises a lower seat engaging portion shown generally at 45 for engaging the seal seat 20 of the cartridge sleeve assembly 14 in a fluid tight manner and a pump barrel shown generally at 34, for receiving and pumping the well fluids 17 into the production tubing 16 as will be explained hereinafter in greater detail. The seat portion 45 includes an upwardly extending annular neck portion 45A terminating in a lip 45B which defines an opening or mouth to the lower portion 45. A set of threads 47 disposed about the inner portion of the neck 45A are adapted to threadably engage the pump barrel 34.

The lower portion 45 of the pump 28 also includes a pair of annular grooves 44 and 46 which are dimensioned to receive a metallic quad seal 44A and a neoprene wiper seal 46A respectively. The seals 44A and 46A are adapted to matingly engaged with seat 20 so that a fluid tight seal is formed between seat 20 and lower portion 45. In this regard, the seals 44A and 46A prevent the fluids discharged in space 21 from flowing downwardly back into the well through opening 20A.

Considering now the pump barrel 34 in greater detail with reference to FIGS. *2a*, *2b*, and 3, the pump barrel 34 generally includes an upper threaded neck portion 42 for threadably attaching the pump barrel 34 to the sealing unit 24 and a lower threaded neck portion 64 for threadably attaching the pump barrel 34 to the lower portion 45 of the pump 28. The pump barrel 34 also includes a centrally disposed elongated hollow pump chamber 35 disposed between the upper and lower neck portions 42 and 64 respectively for receiving well fluids from the well 15. A pump piston 50 is disposed within the pump chamber 35 for pumping the well fluids into and out of the pump chamber 35. The chamber portion 35 includes an inlet 36A and the series of radially extending discharge ports, such as the port 36B and 36C shown in FIG. 2*b* for passing well fluids through the chamber 35 into space 21 It should be understood that the annular space 21 formed between the pump barrel 34 and the cartridge sleeve assembly 14 permits the well fluids within the hollow interior of the sleeve assembly 14 to be passed on the outside of the cartridge unit 13 through the pump, and into the production tubing 16.

The inlet 36A is centrally disposed within the bottom or lower portion 45 and is in fluid communication with opening 20A so that the well fluids 17, passing through opening 20A will flow through inlet 36A into the hollow chamber 35 disposed within the pump barrel 34. The outlet ports, such as port 36B, permit the well fluids within the pumping chamber 35 to be discharged therefrom into space 21 or the hollow interior of the cartridge sleeve assembly 14.

Chamber 35 is integrally formed within the pump barrel 34. The upper end of the pump chamber 35 decreases axially progressively toward a central annular opening 48 to form an annular shoulder 48A. Opening 48 is dimensioned to slidably receive the piston rod 27 that includes a bottom portion 30 (FIG. 3) for threadably securing the piston rod 27 to the pump piston 50. The opposite end of the piston rod is connected to the piston rod coupler 40 for permitting the pump piston 50 to be reciprocated.

The lower end of the pump chamber 35 terminates in a foot check valve 37 that allows an upflow of well fluids into the chamber 35 but prevents down and out flow therefrom. The foot check valve 37 is disposed between inlet 36A and the pump chamber 35 and includes a valve member or ball 37A and a tapered valve seat 37B.

Considering now the pump piston 50 in greater detail with reference to FIG. 2*b* and 3, the pump position 50 is a generally a hollow cylindrical shaped short stubby body connected to the bottom portion of the piston rod 27 for permitting well fluids to pass therethrough. The piston 50 includes a centrally disposed threaded coupling 57 to permit the bottom portion 30 of the piston rod 27 to be threadably connected thereto. The bottom portion 30 of the piston rod 27 includes an axially extending channel or port 52 that permits fluids within the hollow interior of the piston 50 to pass therethrough and be discharged above the piston 50 in chamber 35. In this regard, the pump piston 50 includes a centrally disposed chamber 57 that decreases axially progressively toward a central annular inlet portion 58. Inlet 58 permits fluids within chamber 35 below piston 50 to pass therethrough into chamber 57 and thence through channel 52 to be discharged above piston 50.

In order to control the flow of well fluids through piston 50, a check valve shown generally at 53 is disposed between inlet 58 and chamber 57. Value 53 includes a valve member or ball 55 and a tapered valve seat 54. The check valve 53 allows an upward flow of well fluids into the chamber 57 but prevents down and out from therefrom. In this regard, as the pump piston 50 travels upwardly it forces the check valve 53 to block inlet 58 so that well fluids above the piston 50 will be discharged from the primary chamber 35 above piston 50 and through the discharge outlets, such as outlet 36B, into the annular space 21.

Considering now the upper threaded neck portion 42 in greater detail with reference to FIG. 2, the upper threaded neck portion 42 includes a set of threads 38 disposed on its exterior surface for threadably engaging a threaded coupling 39 disposed on the lower end of the sealing unit 24. A pump barrel gasket seal 64 disposed on the exterior of the top portion 42 of barrel 34 cooperates with the sealing unit 24 so that a fluid tight seal is formed between the gasket 64 and the sealing unit 24 when they are threadably engaged together. The upper threaded neck portion 42 also includes a hollowed out centrally disposed cylindrical recess 43 which is adapted to threadably receive a piston rod sealing plug 44 for sealing the well fluids from the linear motor 26. A set of threads 49 disposed on the interior surface of the neck 42 permit the plug 44 to be threadably engaged within the recess 43. The centrally disposed opening 48 in the top portion of the chamber 35 extends into the base of the recess 43 and is sealed therefrom by plug 44. The hole or opening 48 is dimensioned to permit the piston rod 27 to freely pass therealong.

The piston rod sealing plug 44 includes a centrally disposed opening or bore 46 which is also dimensioned to permit the piston rod 27 to freely pass therethrough. The exterior of plug 44 is threaded for threadably engaging the threads 49 of the top upper neck portion 42 of the pump barrel 34. In order to prevent the leakage of the motor 10 lubricating fluids into the pump chamber 35 and in order to prevent the contaminate leakage of the well fluids into the motor 26, the sealing plug 44 includes a metallic quad pressure seal 61 that is spaced apart from a neoprene wiper seal 62 by a metallic spacer 64.

Considering now the linear d.c. motor 26 in greater detail with reference to FIGS. 1, 2*a*, 2*b* and 5, the linear d.c. motor 26 is electrically connected to the motor controller 12 via the motor control terminator assembly 23 as will be explained hereinafter in greater detail. The linear d.c. motor includes a motor housing unit 25 for mechanically attaching the linear d.c. motor 26 between the sealing unit 24 and the pressure compensator 80. The motor 26 also includes a stator assembly shown generally at 29 and an armature assembly shown generally at 30 that are substantially enclosed in the housing unit 25. The magnetic interaction between the stator assembly 29 and the armature assembly 30 is controlled by the motor control unit 600 as will be explained hereinafter in greater detail.

Considering now the housing unit 25 in greater detail with reference to FIGS. 2A and 2*b*, the housing unit 25 is generally a hollow cylindrical tube including an inner annular wall portion 130 for defining a hollow chamber 132 to enclose the armature assembly 30. A pressure compensating oil 134 (FIG. 4), such as a suitable transformer oil, is disposed within the hollow chamber 132 for helping to facilitate the reciprocating action of the armature assembly within the chamber 132. The wall portion 130 includes an upper and lower portion that is integrally interconnected by the stator 29. In this regard the upper and lower portions of the annular wall 130 are composed of a non-ferrous material to prevent interference of the magnetic flux developed between the stator and the armature assembly 30. A groove (not shown) is channeled in the stator 29 as well as the wall 130 to permit passage of a set of leads that emanate from the motor control unit 600.

The housing 25 also includes a lower threaded neck portion 32 (FIG. 2*b*) having a set of threads 33 for engaging threadably the sealing unit 24. A gasket seal 35 disposed between sealing unit 24 and the housing unit 25 cooperates so that a fluid tight seal is formed between the sealing unit 24 and the housing unit 25 to prevent the well fluids passing over the exterior of the cartridge unit 13 from entering the motor 26. The housing unit 25 also includes an upper threaded neck portion 90 (FIG. 2*a*) having a set of threads 91 for engaging threadably the pressure compensator 80.

Figure 6:
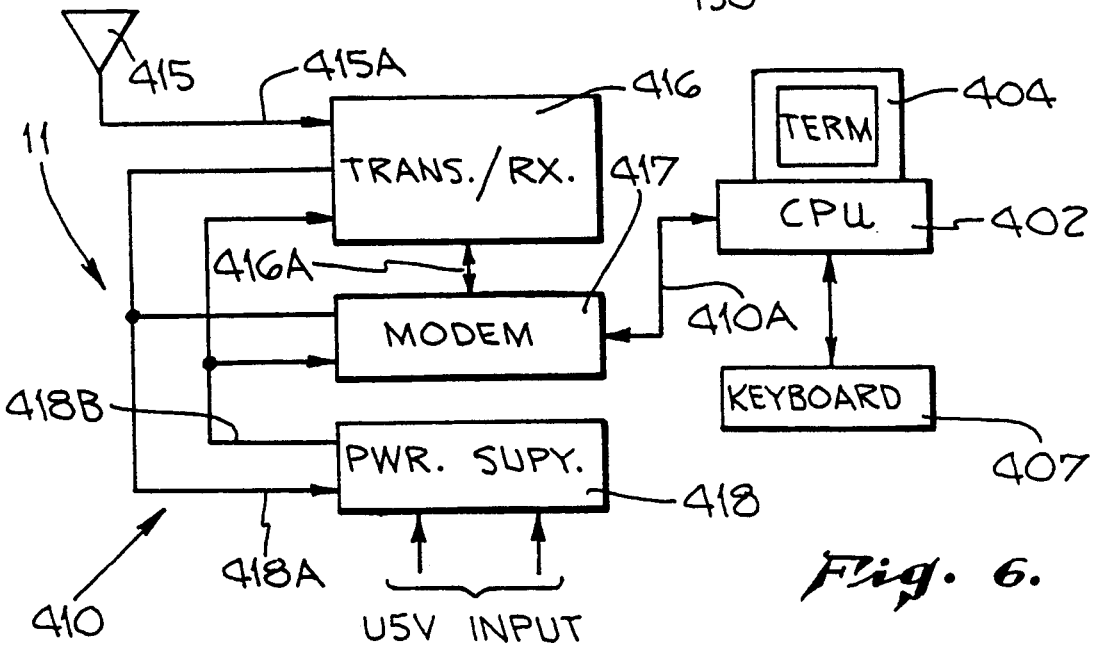
FIG. 6 is a functional block diagram of a control system for use with the downhole linear d.c. motor-pump system of FIG. 2.

Considering now the stator 29 in greater detail with reference to FIGS. 1 and 6, the stator 29 generally includes a plurality of stacked equidistantly spaced apart coils such as coils 612–614. The coils are separated one from another by a plurality of sections of ferrous material, such as sections 632 and 634. The ferrous material sections help concentrate the magnetic flux from each coil and orient its flux in a generally horizontal direction.

A groove (not shown) is channeled in each coil and in each section of ferrous material to permit the passage of a set of leads (606C; 607A–D; 608A, B; 609A, B; 610A, B; and 611A, B) that emanate from the motor control unit 600 for controlling the pulsing of the coils 612–614 and for sensing the position of the armature assembly 29B.

Figure 5:
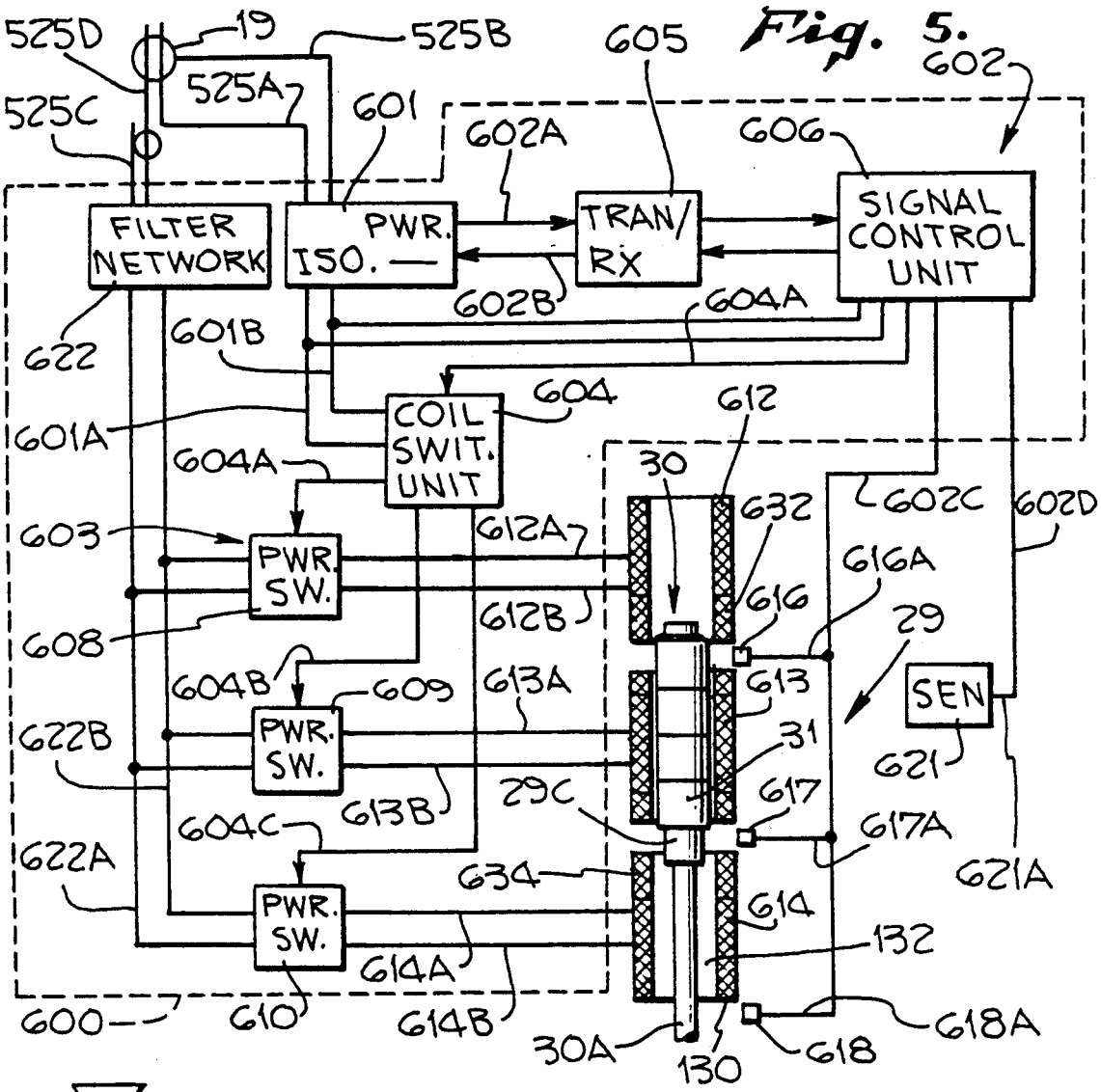
FIG. 5 is a functional block diagram of the downhole motor control unit disposed within the motor-pump cartridge unit of FIG. 1.

Considering now the armature assembly 30 in greater detail with reference to FIGS. 2*a* and 5, the armature assembly 30 includes an armature 30A that is slidably positioned inside chamber 132 and is circumfused by each coil and ferrous material section, such as coils 612–614 sections 632–634. The armature 30A includes a plurality of stacked equidistantly spaced apart permanent magnets, such as magnet 31 (FIG. 5). The magnets, such as magnet 31, are positioned so that the magnetic field forces acting between the coils, such as coils 612–614 achieves a position of equilibrium. In this regard, as will be explained hereinafter in greater detail, as the individual coils 612–614 are pulsed electrically, the magnetic field forces become unbalanced which develops a sufficient movement force to displace the armature assembly 30 slidably inside the chamber 132. When the electrical pulse is removed the armature assembly 30 continues to move in its driven direction until it reaches a new equilibrium position. Reversing the direction of the applied field current to the selected coils develops a driving force in the opposite direction. Thus a reciprocation motion is achieved by the motor 26 which is utilized to drive the pump 28.

As best seen in FIG. 2, the lower end of the armature 30A terminates at its lower end in an integrally formed threaded piston rod coupler 40. The piston rod coupler 40 is adapted to receive threadably the pump connecting rod 27 so the reciprocating action developed by the motor 26 is transferred to the piston rod pump 28 as will be explained hereinafter in greater detail.

Considering now the motor control cable terminator assembly 23 in greater detail with reference to FIGS. 2*a* and 4, the motor control cable terminator assembly 23 generally comprises a hollow generally conical top portion, shown generally at 71, for helping to guide the cartridge unit 13 into the sleeve assembly 19 and guiding the oil discharged from the pump 28 into the production tubing 16. The top portion 71 includes an integrally connected generally cylindrical downwardly depending threaded skirt portion 72 having a set of threads 73 for threadably connecting the motor control/cable terminator assembly 23 to the pressure compensator 80.

As best seen in FIGS. 2 and 4, a cable terminator 74 and the downhole motor control unit 600 are disposed substantially entirely inside the hollow interior of the top portion 73, and are separated from the linear direct current motor 26 by a pressure compensator assembly shown generally at 80 that helps to equalize the dynamic oil pressures between the fluids being pumped from the well and the lubricating oil in the interior of the linear motor 26 as will be explained hereinafter in greater detail. The cable terminator 74 connects the cartridge unit 13 to cable 19 so the cartridge unit 13 can be raised or lowered in the production tubing 16 and interconnects the downhole motor control unit 600 with the electrical conductors in cable 19 for permitting electrical transmission from a surface motor pulse control assembly 500 to the motor control unit 600 as well as the various sensors disposed downhole, such as sensors 616–618 and 621.

Considering now the top portion 71 in greater detail with reference to FIG. 2*a*, the top portion 71 generally includes four radially extending centering fins, such as fin 75. Each of the fins have a generally rectangularly axially extending land, such as land 76 for slidably engaging the inside surface of production tubing 16 when the cartridge unit 13 is raised from the sleeve assembly 14.

In order to permit the well fluids to pass from space 21 into the interior of the production tubing 16 above the sleeve assembly, the top portion 71 also includes four cut out openings or reliefs, such as reliefs 77 and 78, that extend axially and are equally spaced apart and disposed between the fins, such as fin 75. Each of the reliefs taper progressively radially inwardly from the skirt 72 toward the cable 19 disposed above the cartridge unit 13.

In order to permit the well fluids to interact with the pressure compensator assembly, shown generally at 80, the skirt portion 72 includes a set of inlet ports, such as port 79, that permit the well fluids to enter into the hollow space between the cable terminator 74 and the pressure compensator assembly 80. As will be explained hereinafter in greater detail, the pressure compensator assembly 80 establishes a fluid tight seal between the cable terminator 23 and the interior of the linear motor 26.

Considering now the cable terminator 74 in greater detail with reference to FIG. 2*a*, the cable terminator 74 includes a generally conical shaped retainer 84 for engaging an internal tapered shoulder 85 converging radially outwardly from a cable opening 86 to capture the retainer therewithin. Cable 19 passes through opening 86 that is centrally disposed in the top portion 71 and is connected to the retainer by means (not shown). The motor control unit 600 is disposed directly below the retainer 84 and is supported thereby so that the electrical conductors disposed between the control unit 600 and the motor 26 are not stressed when the cartridge unit 13 is raised and lowered in the production tubing 16.

Considering now the oil pressure compensator 80 in greater detail with reference to FIGS. 2*a* and 4, the oil pressure compensator 80 helps maintain the oil pressure in the motor 26 above the fluid pressure produced by the pump 28 and includes a hollowed out pressure compensator barrel 472 having a threaded top portion 474 and a threaded bottom portion 476 for interconnecting the pressure compensator 80 between the motor/cable terminator assembly 70 and the motor housing unit 25 and a hollow chamber 475 disposed thereinbetween. The top portion 474 is also adapted to receive threadably a ported cap 476 for helping to maintain the oil pressure in the motor 26 above the fluid pressure produced by the pump 28. The ported cap 476 has an opening 477 that permits fluid communication between the interior of the pressure compensator barrel 472 and the hollow interior of the motor 26. The compensator barrel 472 also includes an opening or channel 487 for permitting the electrical conductor wires from the motor control unit to be connected electrically to the linear motor 26. A sleeve 488 surrounds the conductor wires in opening 487.

The threaded top portion 474 of the pressure compensation barrel 472 includes a lip 478 which is adapted to retain an O-ring seal 479 between the interior of the barrel 472 and the ported cap 476 when cap 476 is received threadably within the top portion 474. The O-ring forms a seal between the barrel 472 and cap 476 so that fluids may only enter the interior of the barrel through the opening 477. The bottom portion 476 of the barrel 472 includes a recessed groove 478 that is adapted to receive a retaining ring 480. The retaining ring 480 includes a centrally disposed opening 482 and a wall portion 483 that is concentrically disposed relative to the opening 482.

A compensator piston 471 is retained within the hollow interior 475 of barrel 472. The piston 471 includes a centrally disposed groove 473 which is adapted to receive a wiper seal 475 that engages the interior wall of barrel 472. A compensation or tensioned coil spring 485 is disposed between the ported cap 476 and the piston 471 and exerts a constant downward force against the piston 471. In this regard, while piston 471 is free to move within the hollow interior of the barrel 472 the upward path of travel of the piston 71 is limited by cap 476 while its downward path of travel is limited by the wall portion 483 of the retaining ring 80.

Barrel 472 is threadably attached to the housing 25 so that the interior lubricating oils within the motor 26 pass through opening 482 into the hollow interior of the barrel 472 and against the lower portion of piston 471. The wiper seal 475 prevents the lubricating oil from being discharged past the piston into the space above piston 471 where the spring 485 is disposed.

Referring now to FIG. 4, in operation the pressure exerted by the well fluid through opening 477 produces a downward force against the piston 471. Conversely, the pressure exerted by the motor lubricating oil is exerted upwardly against the piston 471. The spring 485 cooperates with downward force exerted by the well fluid thus maintaining the pressure in the motor above the produced fluid pressure. This is expressed by the relation Pw = Well Fluid Pressure
Pc = Compensator Pressure
Pm = Motor Fluid Pressure
X = Displacement Distance of Piston
therefore
$Pw = Pc$
$Pm = Pw + Kx$.

Figure 7:
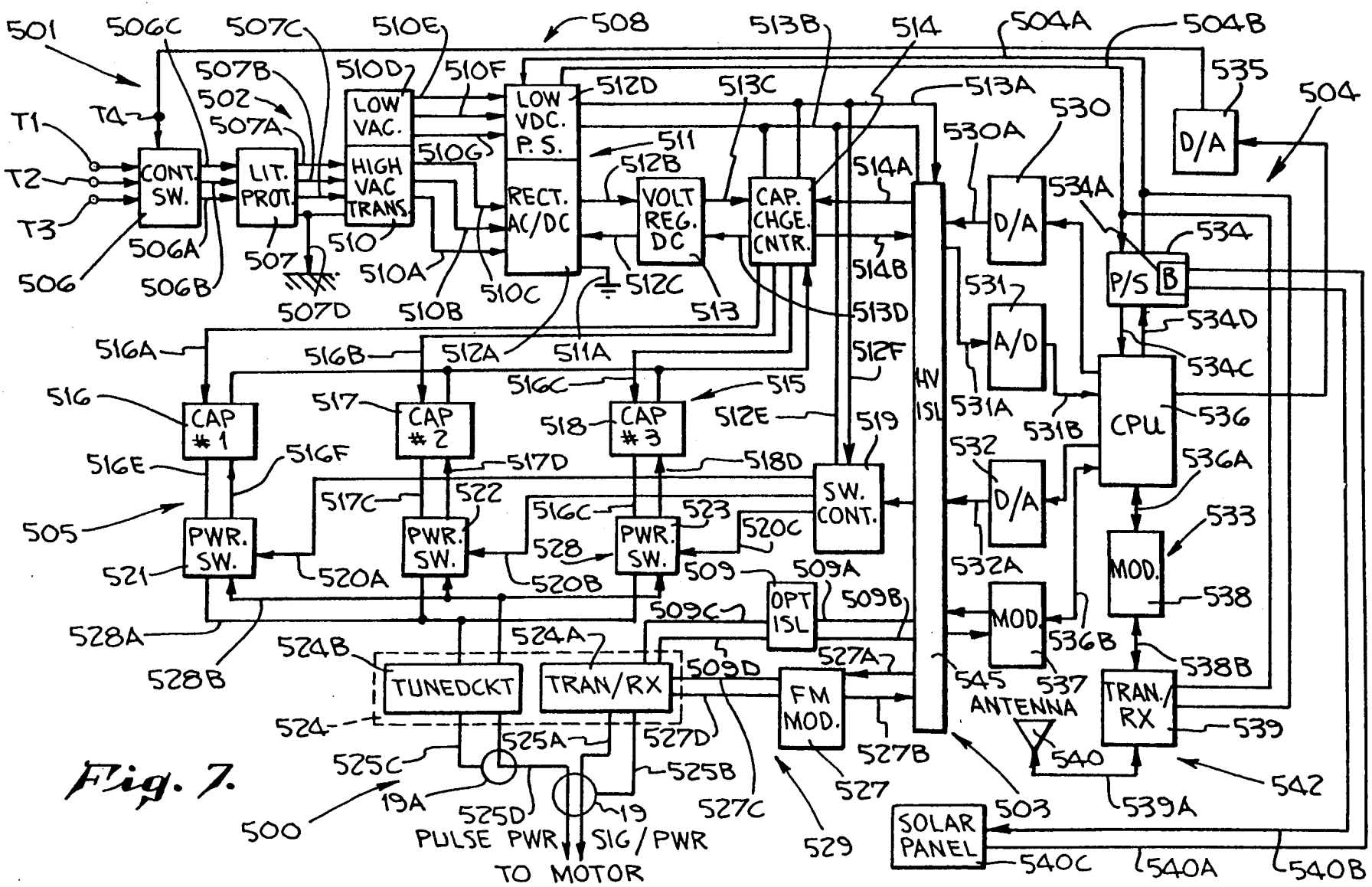
FIG. 7 is a functional block diagram of the surface motor controller of FIG. 1 showing its associated circuitry.

Considering now the motor controller 12 in greater detail with reference to FIGS. 5 and 7, the motor controller 12 generally includes the surface motor pulse control assembly 500 and the downhole motor control electronics unit 600 for controlling the operation of the linear d.c. motor 26. The downhole motor control unit 600 is substantially disposed in the motor control cable terminator assembly 23 for interconnecting the control cable 19 to the motor 26. The surface motor pulse control assembly 500 and the downhole motor control electronics unit 600 will be described hereinafter in greater detail.

Considering now the motor pulse control assembly 500 in greater detail with reference to FIG. 7, the motor pulse control assembly 500 generally comprises a motor pulse control unit 501 for supplying high voltage pulses downhole to the motor 26 and a communications controller 504 for controlling the motor pulse control unit 501 and for transmitting performance data from the cartridge unit 13 to the centrally located control monitoring center 11. The communication controller 504 determines whether a failure condition exists within the pulse control unit 501 or the motor-pump cartridge unit 13 and transmits performance and failure data to the monitoring center 11 via a transceiver 542. The monitoring center 11 evaluates the performance data of the oil well 15 as well as the downhole motor-pump cartridge unit 13.

In order to isolate the high voltage signals of the motor pulse control unit 501 from the low voltage signals of the communication controller 504, the motor pulse control assembly 500 also includes a conventional high voltage isolation network 503 well known to those skilled in the art.

Considering now the motor pulse control unit 501 in greater detail with reference to FIG. 7, the motor pulse control unit 501 generally comprises a high voltage distribution unit or circuit 502 for converting alternating current of an appropriate voltage level from a conventional three conductor power line (not shown) into a high direct current voltage for use in generating the high voltage pulses to be sent downhole to the linear d.c. motor 26. The motor pulse control unit 501 also includes a pulse generating circuit 505 which supplies the high voltage pulses downhole for causing the armature 29A of the linear d.c. motor 26 to be moved in a reciprocating manner. Both the high voltage distribution unit 502 and the pulse generating circuit 505 will be described hereinafter in greater detail.

Considering now the high voltage distribution unit 502 in greater detail with reference to FIG. 7, the distribution unit 502 is powered by a conventional three conductor alternating current source (not shown) and converts or steps up the line voltage; into an appropriate direct current operating high voltage of approximately 1000 VDC for use by the pulse generating circuit 505. The distribution unit 502 generally comprises a conventional electronically controlled power on/off contact switch 506 for turning the system power on and off and a transient or lighting protection circuit 507. The lighting protection circuit 507 helps to prevent, or at least greatly reduce, the possibility of system disruption or even destruction due to different electrical conditions, such as lightning strikes and the like. The distribution unit 502 also includes a power conversion network 508 for supplying the system power and includes a high voltage transformer 510 and high voltage rectifier 511 for stepping up the line voltage, a low voltage power supply 512, and a voltage regulator 513.

Considering now the electronically controlled power switch 506 in greater detail with reference to FIG. 7, the power switch 506 enables the power to the motor pulse control assembly 500 to be turned on and off. The power switch 506 is connected between the transient network 507 and the conventional three conductor power line arrangement (not shown). In this regard, the power switch 506 includes a set of input terminals T1, T2, and T3 that are adapted to be connected to the positive, neutral and ground conductors of the conventional three conductor power line arrangement. Switch 506 also includes a control terminal T4 which is connected to the communication controller 504 for permitting the controller 504 to actuate switch 506 electronically on and off via control signals from the remote monitoring station 11.

Considering now the transient or lightning protection network 507 in greater detail with reference to FIG. 7, the transient network 507 includes a set of metallic oxide varistors (not shown) arranged in a conventional manner for suppressing transient signals which may be developed when switch 506 is switched on or by lightning strikes and the like. The filter network 507 is connected between the high voltage transformer 510 and the switch 506. In this regard, the filter network 507 is connected to switch 506 by a set of conductors 506A, 506B, and 506C and to transformer 510 by a corresponding set of conductors 507A, 507B, and 507C. A common ground conductor 507D also interconnects the filter network 507 to the high voltage transformer 510.

Considering now the power converting network 508 in greater detail with reference to FIG. 7, the power converting network 508 includes the high voltage transformer 510 that converts or steps up the supplied source voltage into an appropriate high voltage level of approximately 1500 VAC.

In order to convert the alternating current high voltage produced by the high voltage transformer 510 into a direct current high voltage of approximately 1000 VAC the power converting network 508 also includes a high voltage rectifier 511. In this regard, the high voltage transformer 510 is interconnected to the high voltage rectifier 511 via a set of conductors 510A, 510B and 510C.

The high voltage transformer 510 also includes a set of low voltage transformer windings 510D to convert the supplied source voltage into appropriate alternating current low voltage levels. In this regard, the low voltage transformer 510D is also interconnected to the high voltage rectifier 511 via a set of conductors 510E, 510F and 510G.

Considering now the high voltage rectifier 511 in greater detail, the high voltage rectifier 511 generally includes a conventional AC/DC rectifier 512A which converts the alternating current voltage supplied via the high and low voltage transformers 510 and 510D respectively into direct current voltage levels. The AC/DC rectifier 512A is interconnected to a low voltage direct current power supply 512D which supplies direct current low voltage of appropriate levels to the isolation network 503 and the communication controller 504 via a set of conductors 513A and 513B and 504A and 504B respectively.

In order to regulate or control the high voltage output of rectifier 512A so that it is maintained at a constant 1000 VDC the power converting network 508 includes a high voltage regulator 513. The AC/DC rectifier 512A is interconnected to the high voltage regulator 513 via a set of conductors 512B and 512C and includes a common ground conductor 511A.

The power distribution unit 502 described above in connection with FIG. 7 provides appropriate direct current voltage levels to the pulse control unit 505, the isolation network 503 and the communication controller 504 respectively. In this regard, the output of the voltage regulator 513 is interconnected to the pulse control unit 505 via a set of conductors 513C and 513D.

Considering now the pulse generating unit 505 in greater detail, the pulse generating unit 505 generally includes a capacitor charge control unit 514 and a capacitor bank 515 that includes a set of capacitors 516, 517 and 518 for storing high voltagecharges to be sent downhole as will be described hereinafter in greater detail. In order to discharge the individual capacitors in the capacitor bank 15, the pulse generating unit 505 also includes a switch control unit 519 and a power switch bank 528. The capacitor charge control unit 514 and the switch control unit 519 are both controlled by the communication controller 504. In this regard, the communication controller 504 sends control signals to the capacitor charge control unit 514 to charge selected capacitors and a corresponding set of control signals to the switch control unit 519 for discharging selected capacitors.

A coupling network 529 is interconnected between the pulse generating unit 505 and the communication controller 504 via the high voltage isolation network 503 for sending the high voltage pulses and control signals downhole for use by the downhole motor control unit 600 as will be described hereinafter in greater detail.

In operation, the pulse control unit 505 under the control of the communication controller 504 causes a set of capacitors 516, 517 and 518 located in capacitor bank 515 to be charged and discharged for producing high voltage electrical pulses which are supplied downhole via the control cable 19. In this regard, whenever the capacitor charge control unit 514 determines that a capacitor in the capacitor bank 515 is fully charged it communicates this information to the communication controller 504. The communication controller 504 in turn, stores this information and sends an enablement signal to the switch control unit 519 via the high voltage isolation network 503 that causes the power switch bank 528 to be activated for discharging the charged capacitor. When the capacitor is discharged a high voltage pulse is sent downhole to the motor-pump cartridge unit 13. The high voltage pulses supplied by capacitors 516–518 are applied to the pulse coils 612, 613, and 614 respectively (FIG. 5) for causing the armature 30 of the linear d.c. motor 26 to be moved in a reciprocating manner. After a given capacitor has been discharged the capacitor charge control unit 514 via the communication controller 504 recharges the discharge capacitor so that it can be discharged again in a repetitive manner.

Considering now the capacitor charge control unit 514 in greater detail, the capacitor charge control unit 514 is connected between the voltage regulator 513 and the capacitor bank 515 for permitting the capacitors 516–518 to be charged to an appropriate voltage level. In this regard, the capacitor charge control unit 514 includes a set of analog switches (not shown) which permit the 1000 VDC output of the direct current regulator 513 to be selectively connected to the individual capacitors in capacitor bank 515 for charging purposes. The outputs of the analog switches are connected to the respective capacitors 516, 517 and 518 by a set of conductors 516A, 516B, 516C and a common return conductor 516D. It should be understood that although in the preferred embodiment three capacitors are shown interconnected to the control unit 514, the pulse generating unit 505 could contain as few as two capacitors for use with very small motor-pump cartridge units having low production capabilities or as many capacitors as may be required to meet the production capability of any given well, such as oil well 15.

The capacitor charge control unit 514 also includes a conventional demultiplexor (not shown) which is interconnected between the analog switches and the communication controller 504 via the high voltage isolation network 503 and a digital to analog converter 530.

In this regard the controller 504 sends a digital control signal to the digital to analog converter 530 for converting the digital control signal to an analog control signal. The analog control signal is then coupled to the demultiplexor via the high voltage network 503. The demultiplexor separates the analog signal into its component parts for activating selected ones of the analog switches.

The capacitor charge control unit 514 also includes a set of conventional charge sensors (not shown) for determining the charge status of each of the capacitors 516–518. The sensors are connected between ground and each of the capacitors. The output signals from the various sensor are multiplexed via a multiplexor (not shown) disposed in the capacitor charge control unit 514. The output of the multiplexor is connected (line 514B) to the communication controller 504 via the high voltage isolation network 503 and an analog to digital converter 531 as will be explained hereinafter in greater detail.

Considering now the switch control unit 519 in greater detail with reference to FIG. 7, the switch control unit 519 controls the firing of the capacitors 516, 517 and 518 and generally includes a conventional demultiplexor (not shown) whose input is connected to the controller 504 via the isolation network 503 and a digital to analog converter 532. The demultiplexor separates the analog signal into a set of control signals for controlling the power switch bank 528 as will be described hereinafter in greater detail.

Considering now the power switch bank 528 in greater detail with reference to FIG. 7, the power switch bank 528 includes a set of SCR's or power switches 520, 521 and 522 respectively. The power switches 520, 521 and 522 are interconnected to the demultiplexor disposed in the switch control unit 519 via a set of conductors 520A, 520B and 520C respectively. As seen in FIG. 7 for each power switch in power switch bank 528 there is a corresponding capacitor in the capacitor bank 515. Thus, whenever a given power switch is activated, by the switch control unit 519 a corresponding capacitor associated with the selected power switch will be discharged.

Considering the switch control unit 519 in further detail, the switch control unit 519 is a low voltage unit and is powered by the low voltage supply 512B via a set of conductors 516C and 516D. The switch, control unit 519 receives sequencing information from the communication controller 504 via the high voltage isolation network 503 and the digital to analog converter 532. The sequencing information determines how the charged capacitors in the capacitor bank 515 will be sequentially discharged. In this regard it should be understood that the motor pulse control assembly 500 is capable of sequencing the discharge of the capacitors in any order; however, in the preferred embodiment of the present invention the capacitors are discharged sequentially 516, 517 and 518 and then reversing fields 518, 517 and 516.

The individual switches 521, 522 and 523 in the power switch bank 528 are connected to the individual capacitors 516, 517 and 518 respectively by conductors 516C and D, 517C and D, and 518C and D. In order to transfer the discharged power from capacitor bank 515 downhole to the motor-pump cartridge unit 13, the outputs of the power switches 521, 522 and 523 are interconnected to the coupling network or circuit 529 via a conductor pair 528A and B.

Considering now the coupling network or circuit 529 of the pulse control unit 502 in greater detail, the coupling network 529 is connected between the power switch bank 528 and the high voltage isolation circuit 503 for sending the high voltage pulses downhole. The coupling network 529 also sends and receives downhole information for controlling the motor 26 and for monitoring status conditions downhole. The coupling network 529 generally comprises an interface circuit 524 having a transceiver 524A for sending and receiving information downhole via a signal/power conductor 525A coupled to cable 19 and a tuned circuit 524B for generating a high voltage frequency signal that will not interfere with the low voltage frequency signal on conductor 525A. The tuned circuit 524B is connected between the power switch bank 528 and the single coaxial conductor 19A via a pair of conductors 525C and 525D. Conductor 525D carries the high voltage pulsed signal and is coupled to the cable 19. The coupling network 529 also includes a conventional optical coupling or isolating device 509 for isolating the low voltage direct current power supply 512D from the high voltage pulses carried downhole via cable 19. The optical coupling device 509 is connected between the transceiver 524A and the high voltage isolator 503 which couples the low voltage from power supply 512D to the coupling device 509 via a pair of conductors 509A and 509B. The optical coupling device is connected to transceiver 524A by a pair of conductors 509C and 509D.

Considering now the transceiver 524A in greater detail with reference to FIG. 7, the transceiver 524A is a conventional full duplex device well known to those skilled in the art. The transceiver 524A generates an fm frequency signal which is impressed on a single power conductor 525A that is coupled to the coaxial cable 19. In this regard, the power conductor 525A supplies both the control signals and low voltage for the downhole motor control unit 600.

For the purpose of demodulating and modulating the carrier signal on conductor 525A, the coupling network 529 also includes a conventional fm modulator/demodulator 527. The fm modulator/demodulator 527 is connected between the transceiver 524 via a pair of conductors 527C and 527D and the high voltage isolator 503 via conductors 527A and 527B. The fm modulator/demodulator 527 modulates control signals received from the communication controller 504 for utilization by the motor control unit 600 downhole. Conversely, the fm modulator/demodulator 527 demodulates the status/condition signal generated downhole for utilization by the communication controller 504.

Considering now the tuned circuit 524B in greater detail, the tuned circuit 524B has its input connected to the power switch bank 528 via the conductor pair 528A and B. The tuned circuit 524B couples the power switch lines 528A and B into the single coaxial conductor cable 19A which is connected to the twinax coaxial power/hoist conductor cable 19.

Considering now the high voltage isolator network 503 in greater detail, the isolation network 503 generally comprises the digital to analog converters 530 and 532 respectively, the analog to digital converter 531 and a conventional isolation coupling network 545. The digital to analog converter 530 is connected via conductor 530A to the coupling network 545 and converts the digital control to analog converter 530 is connected via conductor 530A to the coupling network 545 and converts the digital control signals generated by the communication controller 504 for capacitor sequence charging into analog signals for use by the capacitor charge control unit 514. Similarly, the digital to analog converter 532 is connected via conductor 532A to the coupling network 545 and converts the digital control signals generated by the communication controller 504 for capacitor sequence discharging into analog signals for use by the power switch control unit 519. The analog to digital converter 531 converts the analog signals indicating the charging status of the individual capacitors in capacitor bank 515 into digital signals for use by the communication controller 504. In this regard, the analog to digital converter 531 is connected between the high voltage isolator network 503 via conductors 531A and the communication controller 503 via conductor 531B.

Considering now the communication controller 504 in greater detail, the communication controller 504 generally comprises a microprocessor 536 that controls the charging and discharging of the capacitors and monitors the conditions of the well 15 as well as the downhole motor 26 and the motor control unit 600. A low voltage power supply 534 coupled to the low voltage supply 512D supplies power to the microprocessor 536 and includes a rechargeable battery 534A to maintain controller power in the event of primary power failures. The communication controller 504 also includes a solar panel 540C for recharging the rechargeable battery 534A, associated with power supply 534. The manner in which the microprocessor 536 is programmed to carry the function described herein is In order to automatically control the power on/off sequence of the switch 506 via the remote monitoring center 11, the communication controller 504 also includes a communication network 533 for bi-directional communications with the monitoring center 11 and a digital to analog converter 535 for activating and deactivating the power switch 506.

Considering now the microprocessor 536 in greater detail, the microprocessor 536 is a conventional 8286 CPU unit. The microprocessor 536 is powered by the low voltage power supply 534 via conductors 534C and D which is connected to the low voltage direct current power supply 512D in the power distribution unit 501 via conductors 504A and B. The microprocessor 536 is also connected to the communication network 533 via conductors 536A and 536B respectively.

The communication controller 504 receives capacitor charge information from the control unit 514, armature position location from the motor-pump cartridge unit 13 and then generates a set of sequencing signals which are transmitted to the switch control unit 519 for discharging the capacitors in capacitor bank 515. The controller 504 also generates a control signal which is sent downhole to the downhole motor control unit 600 for controlling the pumping action of the motor-pump cartridge unit 13. The controller 504 also receives a plurality of sensor signals from downhole regarding various condition such as for example, temperature, fluid levels, and armature displacement. The controller 504 transmits this information to the control monitoring center 11 as will be described hereinafter in greater detail.

Considering now the communication network 533 in greater detail, the communication network 533 permits bi-directional communications downhole between the microprocessor 536 and the motor-pump cartridge unit 13. The communication network 523 also permits bi-directional communication between the remotely located monitor control center 11 and the microprocessor 536. The communication network 533 generally comprises a full duplex modem 537 for permitting downhole communications, a full duplex modem 538 for permitting communication to the monitoring center 11 and a radio frequency transceiver 539 and antenna 540 for permitting radio frequency communication between the monitor center 11 and the communication controller 504.

The transceiver 539 is connected between the antenna 540 via conductor 539A and the modem 537 via conductor 538B. The transceiver 539 is powered by the low voltage power supply 512D in the power distribution unit 501 via conductors 504A and B.

As best seen in FIG. 7 the low voltage power supply 534 is connected to the solar panel 540 via conductors 540A and B. The solar panel converts the sun's energy into electrical current for charging a rechargeable battery 534A in the power supply 534. In this regard the power supply 534 could continue operation even though power to the power distribution unit 501 is turned off, thus enabling the communication controller 504 to remain in constant communication with the monitoring center 11.

Considering now the control monitoring center 11 in greater with reference to FIG. 6 the control monitoring center 11 generally comprises a communication network 410 and a microprocessor 402 having a video monitor 404 and keyboard 407. The microprocessor 402 stores data received from the various downhole systems, such as system 9, internally and alerts local personnel as to the existence of a potential or actual failure condition and performance data useful for determining the cause of the potential or actual failure condition. In this regard, the microprocessor 402 is connected to the communication network 410 via a communications conductor 410A. The microprocessor 402 alerts local personnel of these conditions via a CRT 404. It should be understood that other means of communication with local personnel, such as a printer may easily be used. The microprocessor 402 also causes performance modification parameters to be transmitted to a transceiver 406 which is in communication with transceiver 539 associated with the local communication controller 504. In this regard, the transmitted data is received by transceiver 539 and stored internally by the local communication controller 504 for adjusting the performance of the downhole motor-pump cartridge unit 13 and the pulse control unit 502.

Considering now the communication network 410 in greater detail with reference to FIG. 6, the communication network 410 generally includes a transceiver 416, a full duplex modem 417, an antenna 415 and a power supply 418 for providing power. The transmitter 416 is connected between the modem 417 via a conductor 416A and the antenna 415 via conductor 415A. The power supply 418 is connected to both the transceiver 416 and the modem 417 via a conductor pair 418A and 418B. The pump control system 9 described above in connection with FIGS. 6 and 7 is designed to permit a local monitoring center, such as the control monitoring center 11, to monitor a plurality of linear d.c. motor-pump systems, such as system 10 located within its geographical area so that upon the detection of abnormal conditions a serviceman may be immediately dispatched for quick resolution of the problem. In this way, the downtime for any given well is greatly reduced thereby increasing the overall production of oil from a well. Monitoring center personnel are also kept informed as to performance, operating problems, well conditions, and disablement or potential failures in all oil wells associated with the system 9. This provides an extremely valuable management tool to the headquarters operation. Personnel at the monitoring center 11 are enabled to closely monitor the performance of essentially all the oil wells associated with the system. Performance trends can thereby be detected and accurate forecasts devised for use in business planning.

Considering now the motor control unit 600 of the motor controller 12 in greater detail with reference to FIG. 5, the motor control unit 600 generally comprises a power switch control unit 604 for controlling the activation of a power switch bank 603 that includes a set of power switches 608, 609, and 610 for directing the pulse charge sent downhole to a selected one of the pulse coils 612, 613, and 614. The power switch bank 603 is coupled between the pulse coils 612–614 and a filter network 622 which passes the high voltage pulse signals to the power switch bank 603 as will be explained hereinafter in greater detail.

For the purpose of isolating the low voltage control signals from the high voltage pulses sent downhole on conductor 525D the motor control unit 600 also includes an optical power isolator 601. The optical power isolator 601 couples the low voltage direct current power to the power switch bank 603 via a pair of conductors 601A and 601B and couples the low voltage information signal to a transceiver unit 605. The transceiver unit 605 is similar to unit 524A and will not be further described herein.

In order to demodulate and modulate the information signals for transmission via cable 19, the motor control unit 600 also includes a signal control unit 606. The signal control unit 606 will be described hereinafter in greater detail and includes an fm modulator/demodulator (not shown) for demodulating the information signals.

In operation, the motor control unit 600 receives the high voltage pulses from the surface motor control unit 500 and switches these high voltage pulses to the appropriate pulse coils associated with the motor 26. The sequencing of switch is actuated by the switch control unit 603 under the control of the communication controller 504 via the signal multiplexing control unit 602. It should be understood that although the motor controller 12 as shown in the preferred embodiment is disposed partially downhole in the downhole motor control unit 600 and partially on the surface in the motor control unit 500, those skilled in the art could locate the entire motor controller 12 downhole within the motor-pump cartridge unit 13. This of course, would necessitate making the housing of the cartridge unit substantially longer to accommodate the additional electronic components, but such an arrangement would be well known to those skilled in the art.

Considering now the filter network 622 in greater detail, the filter network 622 generally comprises a filter network that permits the high frequency power signal to be coupled to the power switch bank 603. The filter network 622 is connected between the coaxial conductor 524D and the power switch bank 603 via a pair of conductors 622A and 622B.

Considering now the direct current power isolator 601 in greater detail, the ieolator 601 protects the electronic components disposed in the motor-pump cartridge unit 13 from excessive high voltage signals. The isolator 601 is connected between the control cable 19 via coaxial conductors 525A and 525B and the transceiver 605 via conductors 602 and 602B.

Considering now the signal control unit 606 in greater detail, the signal control unit 606 receives on its input lines, such as lines 602C and D the downhole sensor signals from sensors 616, 617, 618 and 621 respectively for transmission surface to the controller 504. A multiplex arrangement (not shown) conditions the input voltages and multiplex the multiple input lines, such as lines 616A, 617A, 618A and 621A down to a smaller number of lines.

For the purpose of separating the sensor activation signals from the coil selection signals, the signal control unit 606 also includes a signal demultiplexor (not shown). The demultiplexor is connected between the sensors, such as sensors 616, 617, 618 and 621 (via conductors 616A, 617A 618A and 621A respectively) and the coil switch unit 604 via conductor 604A.

Considering now the switch bank 603 in greater detail, the switch bank 603 is substantially similar to power switch bank 528. The power switch bank 603 receives the direct current discharge pulse from the filter network 622 and utilizes that signal to create an electromagnetic force that causes the magnetic armature 30 to be moved in a reciprocating manner. Switch bank 603 generally includes the power switches 608, 609 and 610 that are substantially identical to power switches 521, 522 and 523. Switch 608, 609 and 610 have their inputs interconnected to one another by the conductor pair 622A and 622B while the outputs of switches 608–610 are connected to the pulse coils 612, 613 and 614 respectively. There is one switch for each pulse coil disposed within the motor 26. Switch 608 is connected to pulse coil 612 via conductors 612A and B; switch 609 is connected to pulse coil 613; via conductors 613A and B; switch 610 is connected to pulse coil 614 via conductor 614A and B.

Considering now the coil switchunit 604 in greater detail with reference to FIG. 5, the coil switch unit 604 includes a demultiplexor (not shown) for separating the coil selection signal into its individual control signals for controlling the firing of the individual power switches 608, 609, and 610. In this regard, the coil switch unit 604 is interconnected to each of the power switches 608–610 via a set of conductors 604A, 604B and 604C respectively.

The coil switch unit 604 also includes a switching network (not shown) that enables each of the respective control signals to be coupled to their corresponding power switches.

In the preferred embodiment of the present invention there are only three pulse coils, such as coils 612, 613 and 614 required to achieve a reciprocation action that is sufficient to pump downhole fluids from the well. It should be understood that other pulse coil switch units may be added when a greater pumping capacity is desired.

While particular embodiments of the present invention have been disclosed it is to be understood that various coil selection signal into its individual control signals for controlling the firing of the individual power switches 608, 609, and 610. In this regard, the coil switch unit 604 is interconnected to each of the power switches 608–610 via a set of conductors 604A, 604B and 604C respectively.

The coil switch unit 604 also includes a switching network (not shown) that enables each of the respective control signals to be coupled to their corresponding power switches.

In the preferred embodiment of the present invention there are only three pulse coils, such as coils 612, 613 and 614 required to achieve a reciprocation action that is sufficient to pump downhole fluids from the well. It should be understood that other pulse coil switch units may be added when a greater pumping capacity is desired.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

We claim:

1. A system for pumping oil well fluids from downhole to the ground surface comprising:

a surface monitoring station for communicating with at least one remote downhole motor-pump assembly;

said motor-pump assembly including a downhole motor-pump cartridge unit for pumping the well fluids to the ground surface, and a surface motor controller for controlling a linear direct current motor disposed in said motor-pump cartridge unit;

said linear direct current motor including an armature assembly, said motor being coupled to said surface controller by control cable means carrying high voltage direct current pulses to cause said armature assembly in said linear direct current motor to be moved rectilinearly reciprocatively for fluid pumping purposes; and said control cable means further simultaneously carrying low voltage frequency modulated carrier signals for communicating with a downhole motor control electronic unit disposed in said motor-pump cartridge unit to couple said high voltage pulses to selected ones of a plurality of stator pulse coils for causing said armature assembly to be moved rectilinearly reciprocatively.

2. A system for pumping oil well fluids according to claim 1 wherein said control cable is attached to said motor-pump cartridge unit for lowering and raising the cartridge unit through the hollow interior of a production tube extending from the ground surface downwardly to a depth at which liquid is to be pumped from the well.

3. A system for pumping oil well fluids according to claim 2 wherein said production tubing is coupled downhole to a cartridge sleeve assembly adapted to receive the motor-pump cartridge unit in a stationary downhole position within the hollow interior of said sleeve assembly, said sleeve assembly being in fluid communication with the fluids to be pumped from the well.

4. A system for pumping oil well fluids according to claim 3 wherein said cartridge sleeve assembly includes a sealing seat for supporting the motor-pump cartridge unit in a stationary position;

said sealing seat cooperating with said motor-pump cartridge unit for substantially blocking the fluid communication between said sleeve assembly and the fluids to be pumped from the well except through said motor-pump cartridge unit.

5. A system for pumping oil well fluids according to claim 4 wherein said motor-pump cartridge unit includes pumping means for pumping the well fluids through a portion of said motor-pump cartridge unit;

said pumping means including a pumping chamber for receiving a quantity of the well fluids to be pumped from the well, means defining an inlet for establishing fluid communication between said chamber and the fluids to be pumped from the well and for controlling the flow of fluids into and out of said chamber, means defining an outlet for establishing fluid communication between said chamber and the hollow interior of said sleeve assembly, and piston means for moving rectilinearly within said chamber to pump well fluids through said means defining an inlet and said means defining an outlet.

6. A system for pumping oil well fluids according to claim 5 wherein said motor-pump cartridge unit includes a sealing unit disposed between said linear direct current motor and said pumping means for substantially preventing well fluids disposed within said pumping chamber from being in fluid communication with an oil lubricant disposed in the hollow interior of said linear direct current motor.

7. A system for pumping oil well fluids according to claim 6 wherein said motor-pump cartridge unit includes a pressure compensator for maintaining the oil pressure in the linear direct current motor above the fluid pressure produced by the pump.

8. A system for pumping oil well fluids according to claim 1 wherein said motor-pump cartridge unit has a modular construction and includes a linear direct current motor and a piston rod pump for pumping well fluids to the ground surface.

9. A system for pumping oil well fluids according to claim 8 wherein said motor-pump cartridge unit further includes a pressure compensator for maintaining fluid pressure within said linear direct current motor above the fluid pressure produced by said pump.

10. A system according to claim 1 for pumping fluids from a well including a casing, production tubing disposed therein extending downwardly to a depth at which well fluid is to be pumped from the well further comprising:

housing means attached to the downhole terminal end of the production tubing for admitting well fluids into the production tubing, said housing means being in fluid communication with the production tubing and having a hollow interior with an inlet thereto for admitting well fluids;

said linear direct current motor being disposed with said motor-pump cartridge unit, said motor pump cartridge unit being dimensioned to be received within the hollow interior of said housing means for helping to facilitate the transportation of said motor-pump cartridge unit between said housing means and the ground surface, said motor-pump cartridge unit having chamber means for receiving and discharging well fluids, an inlet for admitting well fluids to said chamber means, and an outlet for discharging well fluids from said chamber means into the hollow interior of said housing means and thence into the production tubing;

engaging means for coupling detachably said pump cartridge unit to said housing means and;

sealing means for coupling detachably the inlet of said housing means to the inlet of said pump cartridge unit for admitting well fluids to said chamber means and for helping to prevent well fluids disposed in the production tubing from flowing back into the well.

11. A system according to claim 10, wherein said housing means is a housing unit having an elongated hollow configuration.

12. A system according to claim 11, wherein said housing unit is dimensioned so that its interior width is substantially greater than the interior diameter of said production tube.

13. A system according to claim 10, wherein said pump cartridge means has a hollow interior with said pump means and said motor means disposed therein, said pump means and said motor means cooperating together to permit a pumping action of sufficient force to discharge well fluids from the chamber means of said pump means into the hollow interior of said housing means and thence into the production tubing to a height at which said well fluids will be discharged from the production tubing.

14. A system according to claim 13, wherein said motor means is a direct current linear motor.

15. A system according to claim 14, wherein said cable means includes means for facilitating the raising and lowering of said pump cartridge in the production tubing.

16. A system according to claim 13, wherein said pump is a piston rod pump.

17. A system according to claim 14, wherein said motor means is coupled to said pump means by a rod.

18. A system according to claim 17, wherein said motor means includes coupling means for attaching removably said rod thereto.

19. A system according to claim 10, wherein said pump cartridge means has an elongated hollow configuration having a diameter slightly smaller than the interior diameter of said production tubing for permitting the pump cartridge means to be slidably raised or lowered in said production tubing and includes cable coupling means at its upper terminal end for attaching removably said cable means thereto to help facilitate the insertion and removal of said cartridge means to and from the well via the production tubing.

20. A system for pumping well fluids from well, comprising:

pump means including chamber means for receiving a quantity of well fluid to be pumped to the surface and piston means reciprocatively mounted within said chamber means for pumping well fluids to the surface;

motor means coupled to said piston means for moving said piston means rectilinearly reciprocatively within said chamber means to cause well fluids to be pumped to the ground surface;

said motor means including an elongated stator having a set of coils mounted spaced-apart therealong and having an armature driven by said coils;

means for sensing the position of said armature relative to said coils;

surface motor controller means disposed above ground and responsive to said means for sensing for generating control signals to control the operation of said motor means;

high voltage pulse means responsive to said surface motor controller means for generating high voltage pulses to energize said motor means with electrical power;

downhole control means disposed in the well and responsive to said surface motor controller means for causing individual ones of said high voltage pulses to be directed to selected ones of said coils;

power switch means responsive to said downhole control means for directing said high voltage pulses to selected individual ones of said coils; and cable means for coupling said motor controller means to said control means, for establishing a bidirectional communication patch between said surface motor controller and said downhole control means and for coupling said high voltage pulse means to said power switch means for establishing a one way coil energizing path between said high voltage pulse means and said power switch means.

* * * * *

UNITED STATES PATENT AND TRADEMARK OFFICE

CERTIFICATE OF CORRECTION

PATENT NO. : 5,049,046

DATED : September 17, 1991

INVENTOR(S) : Nelson B. Escue; Vance E. Bolding; Howard C. Hornsby

It is certified that error appears in the above-identified patent and that said Letters Patent is hereby corrected as shown below:

Column 2, Line 49, after "replaced", insert --.--.

Column 2, Line 54, after "assembly", insert --.--.

Column 4, Line 37, after "therein", insert --.--.

Column 5, Line 55, after "2b,", insert --6--.

Column 7, Line 14, after "space 21", insert --.--.

Column 11, Line 65, before "X", insert --K = Spring Tension Force--.

Column 14, Line 16, after "high", delete "voltagecharges" and substitute therefor --voltage charges--.

Column 20, Line 58, after "coil", delete "switchunit" and substitute therefor --switch unit--.

Column 23, line 52, after "claim", delete "14" and substitute therefor --13--.

Signed and Sealed this

Fifth Day of October, 1993

Bruce Lehman

*Attest:*

BRUCE LEHMAN

*Attesting Officer*

*Commissioner of Patents and Trademarks*